United States Patent [19]

Sakaki et al.

[11] 4,301,229

[45] Nov. 17, 1981

[54] ELECTROLYTICALLY GRAINED ALUMINUM SUPPORT FOR MAKING A LITHOGRAPHIC PLATE AND PRESENSITIZED LITHOGRAPHIC PRINTING PLATE

[75] Inventors: Hirokazu Sakaki; Akira Shirai; Azusa Ohashi, all of Shizuoka, Japan

[73] Assignees: Fuji Photo Film Co., Ltd., Minami-ashigara; Nippon Light Metal Co., Ltd., Tokyo, both of Japan

[21] Appl. No.: 24,497

[22] Filed: Mar. 27, 1979

[30] Foreign Application Priority Data

Mar. 27, 1978 [JP] Japan ..... 53/35788

[51] Int. Cl.[3] ..... G03C 1/94; C25D 9/02; C25D 11/10; C25D 11/12

[52] U.S. Cl. ..... 430/158; 204/33; 204/35 N; 204/40; 204/42; 204/58; 204/129.4; 204/129.43; 428/611; 428/612; 428/650; 430/155; 430/160; 430/167; 430/278; 430/287; 430/302; 430/496; 430/166

[58] Field of Search ..... 96/33, 86 P, 86 R, 75; 204/33, 35 N, 58, 40, 42, 129.4, 129.43; 428/611, 612, 650; 430/158, 155, 160, 166, 167, 302, 278, 287, 496

[56] References Cited

U.S. PATENT DOCUMENTS

| | | | |
|---|---|---|---|
| 2,126,017 | 8/1938 | Jenny et al. | 96/86 R |
| 3,072,546 | 1/1963 | Wruck | 96/33 |
| 3,073,765 | 1/1963 | Adams | 204/33 |
| 3,181,461 | 5/1965 | Fromson | 96/33 |
| 3,280,734 | 10/1966 | Fromson | 96/33 |
| 3,330,743 | 7/1967 | Jestl et al. | 96/86 R |
| 3,440,050 | 4/1969 | Chu | 96/33 |
| 3,834,998 | 9/1974 | Watanabe et al. | 204/33 |
| 3,887,447 | 6/1975 | Sheasby et al. | 204/129.4 |
| 3,891,516 | 6/1975 | Chu | 204/33 |
| 3,929,591 | 12/1975 | Chu et al. | 204/33 |
| 4,116,695 | 9/1978 | Mori et al. | 96/33 |
| 4,152,158 | 5/1979 | Chu | 96/75 |

FOREIGN PATENT DOCUMENTS

| | | | |
|---|---|---|---|
| 1224226 | 3/1971 | United Kingdom | 204/58 |

*Primary Examiner*—Charles L. Bowers, Jr.
*Attorney, Agent, or Firm*—Sughrue, Mion, Zinn, Macpeak and Seas

[57] ABSTRACT

A support for a lithographic plate comprising an aluminum plate or an aluminum-alloy plate the surface of which has been grained such that the grain structure comprises pits and;

(i) the distribution of pit diameter is such that the pits corresponding to 5% and 95% on a cumulative frequency curve for pit diameter are about 3μ or more and about 10±1μ in diameter, respectively; and (ii) the center line average roughness (Ra) of said surface is on the range from about 0.6 to 1.0μ. A light-sensitive material for preparing a lithographic plate is also disclosed.

16 Claims, 5 Drawing Figures

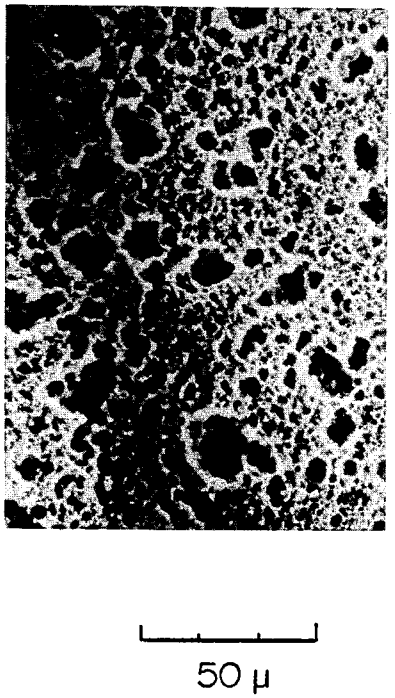
FIG. 1 Type A, X600
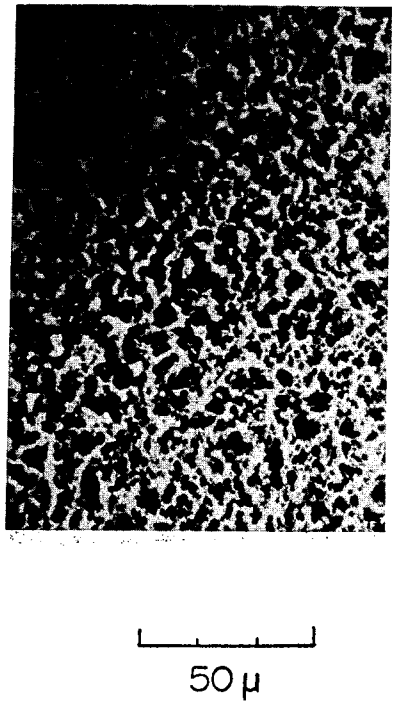
FIG. 2 Type B, X600

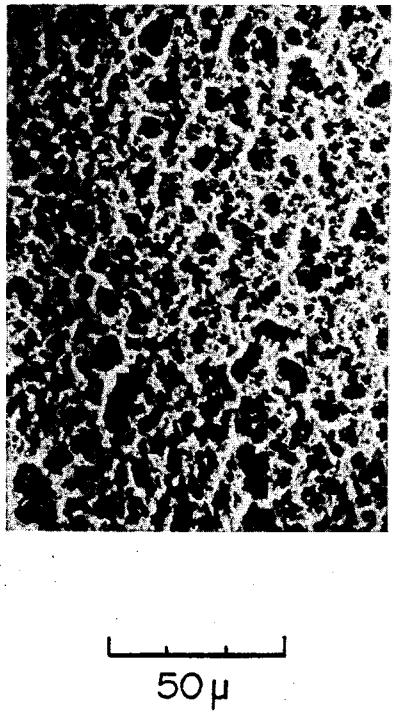
FIG. 3 Type C, X600
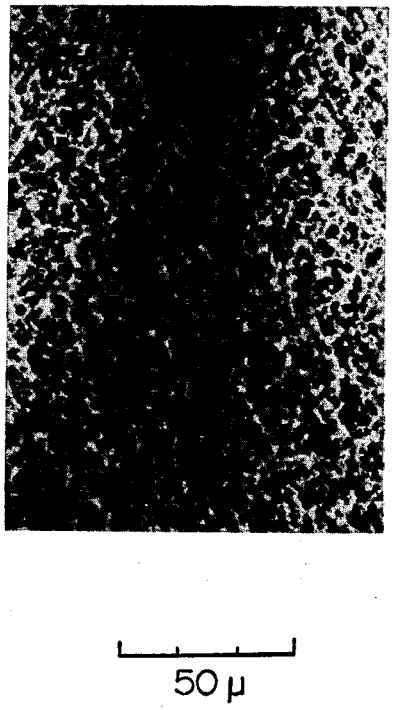
FIG. 4 Type D, X600

ELECTROLYTICALLY GRAINED ALUMINUM SUPPORT FOR MAKING A LITHOGRAPHIC PLATE AND PRESENSITIZED LITHOGRAPHIC PRINTING PLATE

BACKGROUND OF THE INVENTION

1. Field of the Invention

This invention relates to an improved support for a lithographic plate, and more particularly to a support for a lithographic plate comprising a plate of aluminum or an alloy thereof (hereafter referred to as aluminum) which is characterized by the depth of a grain defined by the center line averge roughness (Ra) as well as the average diameter of pits in the grain and the distribution thereof.

2. Description of the Prior Art

Heretofore, an aluminum plate has been widely used as the support of a photosensitive lithographic plate. The surface of the aluminum plate is made coarse to give better adhesion to a photosensitive layer to be disposed on the plate or to provide higher wettability (water retention) with wettening water during printing. This process of surface roughening is called graining and the rough surface obtained is a grain. Two conventional methods of graining are mechanical graining and electrochemical graining. Ball graining which is one example of the former method is a very old method which has found wide utility in small-scale graining operation. However, this method is not efficient since it does not permit continuous operation. An industrially applicable mechanical graining that is substituted for ball graining is brush graining which rotates a brush or roller having steel wires or synthetic resin hairs, optionally in the presence of a sand or abrasive, on an aluminum plate. Whether ball graining or brush graining is used, a grain having various degrees of surface roughness and shape can be produced by properly controlling the kind and shape of the sand, mesh, graining period and brush movement. However, as reported in TAGA (Technical Association of Graphic Arts) Proceedings, pp. 262–276, 1972 mechanical graining leaves residual sand on the surface of the grain as part of the grain. In addition, as shown in the picture taken by a scanning electron microscope in tha technical paper, mechanical graining of an aluminum plate provides a worked surface having a very complicated three-dimensional configuration. Therefore, if a lithographic plate is produced from a presensitized plate having a photosensitive layer disposed on a mechanically grained aluminum plate, the sensitive material penetrates too deeply into the pits in the grain to be removed easily, thus often providing a stained non-image area.

Many studies have been made on electrochemical graining. British Pat. No. 831,998 as well as U.S. Pat. No. 3,072,546 and 3,073,765 disclose an aluminum support for a lithographic plate which is grained by A. C. electrolysis using hydrochloric acid as electrolyte. British Pat. No. 1,224,226 discloses a method of A. C. electrolysis of an aluminum plate in hydrochloric acid, followed by chemical etching and anodization. Japanese Patent Publication No. 27481/71 discloses a method of A. C. electrolysis of an aluminum plate in hydrochloric acid, followed by anodization.

It is generally known that A. C. electrolysis of an aluminum plate in an electrolyte mainly consisting of hydrochloric acid or nitric acid can provide the aluminum plate with a grained surface. The grain provided by electrochemical graining which is formed of grown pits has a crater-like or honeycomb stucture and is characterized by having straight and open pits as compared with the grain produced by mechanical graining described above. Another feature of electrochemical graining is that it provides a plate having deeper pits and a coarser grain then mechanical graining. The configuration and coarseness of the grain can be controlled by selecting the electrolyte and electrolytic conditions used. West German Patent (OLS) No. 2,650,762 describes the grain provided by electrochemical graining using hydrochloric acid or nitric acid as an electrolyte. A coarse-grained surface obtained by using nitric acid or an electrolyte mainly consisting of nitric acid produces pitting having a dual structure which comprises a pit provided by electrochemical etching plus an extremely small pit formed in its surface, but the opening is generally shallow. On the other hand, the use of hydrochloric acid or an electrolyte mainly consisting of hydrochloric acid provides pitting which is generally deep but the surface of individual pits is relatively smooth without a complex configuration as achieved by use of a nitric acid based electrolyte.

Although an aluminum plate grained electrochemically has a by far a coarser surface than a mechanically grained aluminum plate, it has not yet been considered a preferred support having advantages over and replacing the conventional supports for lithographic plates. Among the problems yet to be solved with an electrochemically grained aluminum plate are its low affinity for ink, short running life (number of sheets of paper which can be printed from one plate), its low printing sensitivity and low developing speed.

SUMMARY OF THE INVENTION

It is therefore one object of this invention to provide a support for a lithographic plate having a long running life.

It is another object of this invention to provide a support for a lithographic plate which has high adhesion to an image forming layer for forming an image pattern with affinity for ink and which exhibits stable affinity for ink as the image area wears during the printing operation to thereby supply a printed product of good quality.

It is a further object of this invention to provide a support for a lithographic plate which is capable of increased printing sensitivity by coating the support with a thinner photosensitive layer than used with conventional supports for a lithographic plate for forming an image pattern with affinity for ink.

It is still another object of this invention to provide a support for a lithographic plate which is more hydrophilic and retains more water than the conventional support for a lithographic plate and which is capable of supplying easily and stably a printed product with a remarkably sharp image.

As a result of various studies on a support for lithographic plate provided with capabilities higher than the conventional known support for a lithographic plate, it has been found that the depth of the grain characterized by surface coarseness as well as the average diameter of the pitting and its distribution are two factors that are very important for improving various properties of the support. This finding is applicable to every type of grain having distinct pitting on the surface whether it is produced by mechanical graining or electrochemical graining. This invention permits manufacture of an inexpensive support for a lithographic plate with improved affinity for ink and a longer running life, requiring only a very short period of time for printing.

BRIEF DESCRIPTION OF THE DRAWINGS

FIGS. 1 to 4 are scanning electron microscope photographs showing the pits in various types of grain.

DETAILED DESCRIPTION OF THE INVENTION

Figure 5:
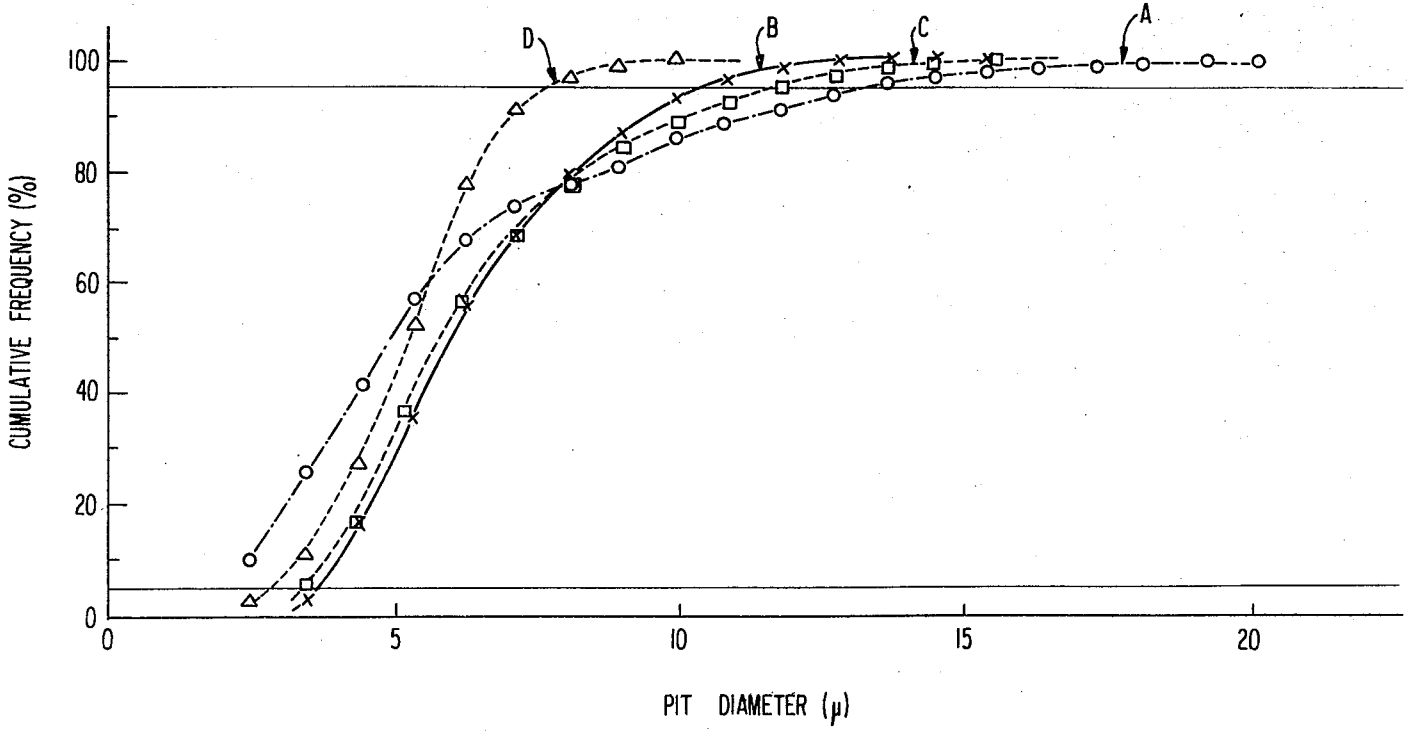
FIG. 5 is a cumulative frequency curve for the pit diameter as measured from the pictures in FIGS. 1 to 4. A cumulative frequency curve for pit diameter for purposes of this application is a curve obtained by plotting the number of pits having a specific diameter in a 0.1 $mm^2$ area by approximating the pit diameter by a circle and neglecting pits having a diameter less than 2 microns, versus the cumulative frequency with which the specific pit diameter occurs.

The above objects are achieved with a support for a lithographic plate which meets the following requirements:

(i) it possesses a grain structure comprising pits in the surface of an aluminum plate having a pit distribution wherein pits corresponding to 5% and 95% on a cumulative frequency curve of pit diameter are about 3μ or more (preferably 3 to 5μ) and about 10±1μ (9 to 11μ) across, respectively (reference should be made to accompanying FIG. 5); and (ii) the grain has a center line average roughness (Ra) in the range from 0.6 to 1.0μ.

These requirements are shown in the accompanying pictures taken by an electron microscope. FIGS. 1 to 4 are 600X magnified pictures of pits in various types of grain as observed under a scanning electron microscope. These pictures show pits most of which are of a size in the range from 5 to 15μ.

By the term "pits" is meant the configuration of a grained surface as observed through a scanning electron microscope at a magnification power of 100 to 700X.

The grain of type A in FIG. 1 has the disadvantages of a short running life and long printing time. The grain of type B in FIG. 2 is the grain according to this invention. The grain of type C in FIG. 3 does not have a satisfactorily long running life. The grain of type D in FIG. 4 is poor in water retention.

FIG. 5 shows a cumulative frequency curve for the number of pits and diameter as measured with the pits contained in a 0.1 $mm^2$ area of these types of grain by approximating the pit diameter by a circle and neglecting the pits having a diameter less than 2μ. As can be seen from FIG. 5, the grains of types A and C have many large pits whereas those of type B and D comprise fine and uniform pits. The former group of grain (A, C) is distinguished from the latter group (B, D) by the presence of large pits which have been found to be about 10 to 30μ across and detrimental to a long running life and high printing sensitivity.

As is clear from FIGS. 2 and 3, the grain of FIG. 2 (type B) has no pits larger than 12μ whereas the grain of FIG. 3 (type C) contains such pits and provides a support for lithographic plate which exhibits only a short running life. Table 1 sets forth the average roughness of a grain of each type (A to D), the mean value of the pit diameter and the standard deviation from said value.

The center line average roughness of a grain (Ra) is expressed in milli-microns by the formula (I):

$$Ra = \frac{1}{L} \int_{O}^{l} f(x)\, dx \qquad \text{(I)}$$

To calculate Ra, a portion of a measured length L is sampled from a roughness curve along its center line in accordance with JIS-B0601 (1970), with the roughness curve expressed by y=f(x) wherein the x-axis represents the center line of the sampled portion and the y-axis the vertical direction thereof. Measurement of the center line average roughness (Ra) of a grain was performed with a cut-off value set at 0.8 mm.

TABLE 1

| | Pits in various types of grain | | |
|---|---|---|---|
| Grain type | Ra (μ) | Average pit diameter (μ) | Standard deviation (μ) |
| A | 0.8 | 6.3 | 3.5 |
| B | 0.7 | 6.8 | 1.7 |
| C | 0.9 | 6.8 | 2.0 |
| D | 0.5 | 5.6 | 1.4 |

Obviously, the grains of type A and C provide a wide distirbution of pit diameter. The grain of type D has fine and uniform pits but its average roughness is smaller than the other types. As type D in Table 1 indicates, a grain with poor water retention has only a small degree of average roughness. Close examination has revealed that water retention is very closely related to average surface roughness and that a coarser surface has imporved water retention. As a result of printing from samples having various degrees of average roughness, it has also been found that satisfactory water retention requires an average roughness of at least 0.6μ, preferably 0.6 to 1.0μ. On the other hand, a grain having an average roughness larger than 1μ has been found to provide too low a printing sensitivity to effect the intended development. Therefore, for the purposes of this invention, a grain advantageously has a center line average roughness in the range from 0.6 to 1.0μ.

That is, the water retention is improved when the average roughness is in the range of 0.6 to 1.0μ and the printing life is improved when pit diameter range is 3 to 5 microns for the 5% cumulative frequency level and 9 to 11 microns for the 95% cumulative frequency level.

The aluminum plate to be used in this invention includes pure aluminum and aluminum alloy plates. Various kinds of aluminum alloy can be used, for example, alloys with silicon, copper, manganese, magnesium, chromium, zinc, lead, bismuth and nickel. Specific examples of the suitable aluminum alloys are set forth in Table 2 below wherein all numerical figures are in terms of percent by weight, and the balance is aluminum.

TABLE 2

| | Al-Alloys* | | | | | |
|---|---|---|---|---|---|---|
| Alloy No. | Si | Cu | Mn | Mg | Cr | Zn |
| 1S | 0.25 | — | — | — | — | — |
| 2S | 0.4 | — | — | 0.6 | — | — |
| 3S | — | — | 1.2 | — | — | — |
| 24S | — | 4.5 | 0.6 | 1.5 | — | — |
| 52S | — | — | — | 2.5 | 0.25 | — |
| 61S | 0.6 | 0.25 | — | 1.0 | 0.25 | — |
| 75S | — | 1.60 | — | 2.50 | 0.30 | 5.60 |

*balance aluminum

These aluminum-alloy compositions may contain a small amount of iron or titanium and negligible amounts of other impurities, which are not listed in the table above.

Since the surface of an aluminum plate is fouled with oil, rust, dust and other contamination, it is common practice to expose a clean surface by chemically treating the plate in accordance with a suitable method such as described on pages 186–210 of "A Handbook of Metal Surfacing Techniques" by Nihon Kogyo Shinbunsha, which includes degreasing with a solvent such as trichloroethylene, alkali such as caustic soda, and other chemicals. Degreasing with an alkali such as caustic soda may produce smut which is generally removed with 10 to 30% nitric acid.

Various methods of graining can be used in this invention, such as those described in British Patent 831,998, U.S. Pat. Nos. 3,072,546, and 3,073,765, British Patent 1,224,226, and West German Disclosed Patent (OLS) 2,650,762.

To prepare a photosensitive lithographic plate from an aluminum plate grained in accordance with this invention, the latter is advantageously washed with water and anodized. A typical electrolyte is sulfuric acid but an aqueous or non-aqueous solution of phosphoric acid, chromic acid, oxalic acid, sulfamic acid, benzenesulfonic acid may also be used individually or as a mixture. Application of current through such electrolyte to the aluminum anode provides the surface of the aluminum plate with an anodized film.

The conditions for anodization largely depend on the electrolyte used, but according to generally advantageous conditions, the electrolyte has a concentration in the range from 1 to 80 wt. %, a temperature in the range from 50° to 70° C., a current density in the range from 0.5 to 60 amperes/dm$^2$, a voltage applied at 1 to 100 volts, and electrolysis performed for a duration of 30 seconds to 50 minutes. Preferred anodizing conditions are set forth in the Table 3 below.

TABLE 3

| | Anodizing Conditions | | | | |
|---|---|---|---|---|---|
| Electrolyte | Concentration of electrolyte (aqueous solution) in wt % | Temperature of electrolyte (°C.) | Current density (A/dm$^2$) | Voltage (volts) | Duration of electrolysis (min.) |
| Sulfuric acid | 1~70 | 5~65 | 0.5~30 | 1~50 | 1~30 |
| Oxalic acid | 1~20 | 20~60 | 0.5~20 | 10~70 | 5~40 |
| Phosphoric acid | 2~60 | 20~60 | 0.5~20 | 10~60 | 1~30 |
| Chromic acid | 2~30 | 20~60 | 0.5~10 | 10~60 | 1~50 |

In the present invention an aluminum or aluminum alloy plate can be grained by electrochemical graining procedure under the conditions shown in Table 4 using a normal alternating current (A.C.) or special waveforms as disclosed, for example, in German OLS No. 2,650,762.

TABLE 4

| Electrochemical Graining Conditions | Normal A. C. | Special Waveforms |
|---|---|---|
| Anodic Voltage | 1–50 Volt | 2–30 Volt |
| Cathodic Voltage | 1–50 Volt | 2–30 Volt |
| Anodic Current Density | 10–100 A/dm$^2$ | 10–60 A/dm$^2$ |
| Cathodic Current Density | 10–100 A/dm$^2$ | 10–60 A/dm$^2$ |
| Temperature | 15–45° C. | 15–45° C. |
| Electrolyte | HCl, $HNO_3$ or Mixture thereof | |
| Electrolyte Concentration | 0.5 to 30% by weight | |
| Duration of Treatment | 10 to 300 seconds | |

Supports for lithographic printing plates in accordance with the present invention using the specific aluminum alloys in Table 5 can be prepared under the conditions shown in Table 4.

TABLE 5

| Type of Al/Al Alloy | 1S | 2S | 3S | 24S | 52S | 61S | 75S |
|---|---|---|---|---|---|---|---|
| Anodic Voltage (V) | 1–30 | 1–40 | 1–40 | 2–50 | 1–50 | 1–50 | 1–50 |
| Cathodic Voltage (V) | 1–30 | 1–40 | 1–40 | 2–50 | 1–50 | 1–50 | 1–50 |
| Anodic Current Density (A/dm$^2$) | 10–80 | 10–80 | 10–100 | 10–100 | 10–100 | 10–100 | 10–100 |
| Cathodic Current Density (A/dm$^2$) | 10–80 | 10–80 | 10–100 | 10–100 | 10–100 | 10–100 | 10–100 |
| Temperature (°C.) | 15–45 | 15–45 | 15–45 | 15–45 | 15–45 | 15–45 | 15–45 |
| Duration of Treatment (sec.) | 10–200 | 10–300 | 10–300 | 10–300 | 10–300 | 10–300 | 10–300 |

The grained aluminum plate now provided with an anodized film is stable ad highly hydrophilic per se, and so it can immediately be coated with a photosensitive layer, but it may be subjected to a further surface treatment as required. Among examples of the suitable surface treatments for improving adhesion as well as to render the surface hydrophilic are treatment with an aqueous solution containing an alkali metal silicate such as sodium silicate, potassium fluorozirconate, or phosphate glass (as disclosed in U.S. Pat. Nos. 3,181,461; 2,714,066; 2,946,683) and provision of a subbing layer comprising a hydrophilic polymer such as polyvinyl benzene sulfonic acid, polyacrylic acid, carboxymethylcellulose, polyacrylamide, polyvinyl alcohol, polyvinyl pyrrolidone, and a polyethylene/maleic anhydride copolymer. The subbing layer of such hydrophilic polymers can be coated in the form of an aqueous solution, a solution of organic solvent or a solution comprising a mixture of the two. It is particularly preferred to coat the subbing layer from an organic solvent containing 0 to 50 vol. % of water (for example, alcohols such as methanol, ethanol and propanol; ketones such as acetone and methyl ethyl ketone; glycol monoethers such as ethylene glycol monomethyl ether, ethylene glycol monoethyl ether, and ethylene glycol monomethyl ether acetate; dimethyl formamide and dimethyl sufoxide). The preferred coating weight of the hydrophilic polymer is in the range from 5 to 150 mg/m$^2$. These methods of surface treatment can be used independently or in combination of two or more methods.

The aluminum support thus prepared is then coated with a photosensitive composition which includes organic or inorganic sensitizers, photosensitive resins or photoresists conventionally used to make plates for printing which are irradiated with light that causes polymerization, cross-linking, dimerization, breaking of crosslinkages, decomposition, rearrangement and other photochemical changes to thereby have their solubility in a solvent varied. Among the examples of such photosensitive composition are:

1. A composition comprising a hydrophilic polymer such as gelatin and glue as combined with a photosensitive ferric salt which upon exposure to light provides ferrous irons such as ferric ammonium citrate, ferric ammonium oxalate, and ferric sodium oxalate, as disclosed in British Pat. Nos. 883,811 and 1,082,932.

2. A composition comprising a hydrophilic polymer such as gelatin, fish glue, gum arabic, polyvinyl alcohol, polyacrylamide, carboxymethylcellulose, hydroxyethylcellulose, a copolymer of polyvinyl methyl ether and maleic anhydride combined with a tetrazonium salt of a diamino compound such as P-aminodiphenylamine, benzidine, dianidine and toluidine or a diazo resin produced by condensing P-diazodiphenylamine and paraformaldehyde, as disclosed in U.S. Pat. Nos. 2,937,085 and 2,722,160.

3. A diazo compound; especially diazodiphenylamine, a condensate of a compound having a reactive carbonyl group (for instance, formaldehyde or paraformaldehyde) and diazodiphenylamine, or an uncured photosensitive reaction product of diazodiphenylamine or a condensate thereof and a hydroxyl group containing aromatic coupler, as disclosed in U.S. Pat. Nos. 2,649,373; 3,046,121; 3,046,122; and 3,046,123.

4. A composition comprising an azido compound such as sodium 4,4'-diazidostilbene-2,2'-disulfonate, sodium 1,5-diazidonaphthalene-3,7-disulfonate, sodium 3'-azido-4-azidobenzalacetophenone-2-sulfonate, sodium 4,4'-diazidostilbene-alpha-carboxylate, sodium di (4-azido-2'-hydroxybenzal) acetone-2-sulfonate, sodium 4-azidobenzalacetophenone-2-sulfonate, and sodium 4,4'-diazidodiphenyl3,3'-disulfonate as combined with a polymer such as polyacrylamide, polyvinyl pyrrolidone, polyacrylic acid, gelatin, casein, albumin gum arabic, carboxymethylcellulose, hydroxyethylcellulose or soluble nylon, as disclosed in U.S. Pat. Nos. 3,118,765 and 3,348,948.

5. A composition comprising an azido compound such as 4,4'-diazidostilbene, 4,4'-diazidochalcone and 4,4'-diazidodibenzal-acetone as combined with a cyclized rubber, synthetic rubber or a polymer soluble in an organic solvent, as disclosed in DAS No. 2,230,969.

6. A composition comprising a quinone diazido compound such as naphthoquinone-1,2-diazidosulfonate ester or sulfonic acid as combined with an alkali soluble resin as disclosed in U.S. Pat. No. 3,635,709.

7. A compound which is dimerized upn exposure to actinic radiation such as polyvinyl cinnamate, polyvinyl cinnamoyl ethyl ether, polyethyl cinnamate acrylate and copolymers thereof; polyethyl cinnamate methacrylate and copolymers thereof; polyparavinyl phenyl cinnamate and copolymers thereof; polyvinylbenzal acetophenone and derivatives thereof; polyvinyl cinnamylidene acetate and derivatives thereof; allyl acrylate prepolymers and derivative thereof; a derivative of a polyester resin comprising paraphenylene diacrylic acid and polyhydric alcohol; one example of such compound is disclosed in U.S. Pat. No. 3,030,208.

8. A compound which is polymerized upon exposure to actinic radiation, such as a compound having two or more terminal ethylene groups as disclosed in U.S. Pat. Nos. 2,760,863 and 3,060,023; among examples of such compound are ethylene glycol di-acrylate and dimethacrylate; propylene glycol diacrylate and dimethacrylate; diethylene glycol diacrylate and dimethacrylate; triethylene glycol diacrylate and dimethacrylate; dipropylene glycol diacrylate and dimethacrylate; trimethylolethane triacrylate and trimethacrylate; trimethylolpropane triacrylate and trimethacrylate; tetramethylolmethane tetracrylate and tetramethacrylate; methylene bisacrylamide; 1,6-hexamethylene bisacrylamide, etc.

Of the photosensitive compositions mentioned before, compositions 3, 4, 6, 7 and 8 are particularly preferred.

The above illustrated compounds which are dimerized or polymerized upon exposure to actinic radiation may further include a resin binder, sensitizer, thermal polymerization inhibitor, dye and plasticizer. Examples of the suitable binders are described in U.S. Pat. Nos. 3,203,805; 3,458,311; 3,060,026; and 3,046,127. Other suitable examples which may be used in this invention are vinyl ester polymer and copolymer, polyvinyl alcohol, polyvinyl acetate, polyvinyl butyrate, and an addition polymer including polyvinyl acetal such as polyvinyl butyral or polyvinyl formal, and a saturated or unsaturated polyglycerol phthalate and polyglycerol malate and other alkyd-type polymers.

Examples of the useful sensitizer are anthracene, phenanthrene, chrysene, o-nitroanisole, beta-nitrostyrene, paranitrodiphenyl, 5-nitro-2-aminotoluol, 4-nitroaniline, 2,4,6-trinitroaniline, 4-nitro-2-chloroaniline, anthrone, 1-cyano-2-keto-3-methyl-6-bromo-3-azobenzanthrone, 2-keto-3-methyl-1,3-diazobenzanthrone, 1,2-benzanthraquinone, beta-chloroanthraquinone, dibenzalacetone, malachite green, benzoin, benzoin methyl ether, benzoin ethyl ether, 9,10-anthraquinone, 1-chloroanthraquinone, 9,10-phenanthraquinone, leucotriphenylmethane, 2-benzoylmethylene 1-methyl-beta-naphthothiazoline, 5-nitroacenaphthene, beta-chloroanthraquinone, 1,2-benzalanthraquinone, p,p'-tetra-ethyldiamino diphenyl ketone, p,p'-dimethylaminobenzophenone and 4-nitro-2-chloroaniline. Such sensitizer is preferably used in an amount ranging from 0.5 to 15% by weight, more preferably from 2 to 8% by weight, based on the weight of the compound to be dimerized or polymerized.

Preferred examples of the dye are Phthalocyanine Blue (C.I. 74160), Carmine 6B (C.I. 15850) and Rhodamine B Lake (C.I. 45170); other dyes such as Oil Blue BO (C.I. 74350) may also be used. While the amount of the dye to be added varies with the weight of the photosensitive composition to be coated, it is generally in the range from 1 to 50% by weight, preferably in the range from 2 to 15% by weight, based on the photosensitive composition.

Examples of the suitable plasticizer are phthalate esters such as dibutyl phthalate, diheptyl phthalate and dioctyl phthalate; glycol esters such as ethyl phthalyl ethyl glycolate, butyl phthalyl butyl glycolate, and triethylene glycol dicaprilate ester; esters of aliphatic dibasic acids such as dioctyl adipate, diisobutyl adipate, dibutyl sebacate, and dioctyl azelate; glycerol tributylate; and phosphate esters such as trischloroethyl phosphate, tricresyl phosphate and triphenyl phosphate. Such plasticizers are used in an amount ranging from 5 to 60% by weight, preferably from 15 to 40% by weight, based on the weight of the photosensitive composition.

Printing dyes may be added to the photosensitive composition of which spiropyran compounds are preferred, which are typified by: 6'-nitro-1,3,3-trimethylspiro (indoline-2,2'-2'H-chromene), 8'-formyl-1,3,3-trimethylspiro (indoline-2,2'-2'H-chromene), 6',8'-dichloro-1,3,3-trimethylspiro (indoline -2,2'-2'H-chromene), and 8'-methoxy-6'-nitro-1,3,3-trimethylspiro (indoline-2,2'-2'H-chromene). These compounds are used in an amount ranging from 0.5 to 20% by weight, preferably from 1 to 8% by weight, based on the weight of the photosensitive composition.

The photosensitive layer according to this invention may further contain a thermal polymerization inhibitor such as hydroquinone, p-methoxyphenol, and 4,4'-thiobis (3-methyl-6-tertiary-butyl phenol).

The support of this invention is coated with the photosensitive compositions defined herein, normally in the form of a solution in water, organic solvent or a mixture thereof, and then dried to form a presensitized lithographic plate.

The coating thickness of the photosensitive composition is generally in the range from about 0.1 to about 3.5 g/m$^2$, preferably from about 0.5 to about 2.5 g/m$^2$.

The presensitized lithographic plate thus prepared is exposed imagewise to light from a source of actinic radiation such as a carbon-arc lamp, xenon lamp, mercury vapor lamp, tungsten lamp and a metal halide lamp, and developed to provide a lithographic plate. To provide a lithographic plate by lithography, all the surface of the imagewise exposed and developed plate is coated with a lacquer and tincture, with the image area formed by said imagewise exposure and development as well as the overlying lacquer and tincture layers being removed to provide an intended lithographic plate.

This invention is hereunder described in greater detail by reference to the following examples which are given for illustrative purpose only and are by no means intended as limiting this invention. In the examples, all percents are percents by weight.

EXAMPLE 1

A pure aluminum plate 0.3 mm thick (JIS 1050) was treated with a 20% aqueous sodium hydroxide solution at 40° C. for 20 seconds. After washing with water, the plate was immersed in a 25% aqueous nitric acid solution at 20° C. for 20 seconds, and washed with water.

The plate was then electrochemically grained in a ]g/l aqueous hydrochloric acid solution using the special alternating waveform described in West German Patent Application (OLS) No. 2,650,762 under the electrolytic conditions of an anodic voltage of 18 volts, a cathodic voltage of 3.5 volts, an anodic current density of 110 amperes/dm$^2$, a cathodic current density of 17 amperes/dm$^2$, a temperature of 36° C. and for a duration of 84 seconds. The grained plate was then washed with water.

An observation of the surface of the grained plate under a 600-power scanning electron microscope revealed that the pits corresponding to 5% and 95% on the cumulative frequency curve for pit diameter were 3.5$\mu$ and 9.5$\mu$ in diameter, respectively.

The support was subsequently immersed in a 15% aqueous sulfuric acid solution for 30 seconds, flushed with water, and anodized in 20% sulfuric acid (30° C.) at a current density of 8 amperes/dm$^2$ to thereby provide an anodized film having an oxide film weight of 3 g/m$^2$.

The support thus prepared was coated with 2.5 g/m$^2$ of a photosensitive composition of the following formulation:

| | |
|---|---|
| An esterified product of naphthoquinone-1,2-diazido-5-sulfonyl chloride and pyrogallol acetone resin (as described in Example 1 of U.S. Pat. No. 3,635,709) | 0.75 g |
| Cresol novolac resin | 2.00 g |
| Tetrahydrophthalic anhydride | 0.15 g |
| Oil Blue #603 (manufactured by Orient Kagaku) | 0.04 g |
| Orthoquinone diazido-4-sulfonic acid chloride | 0.04 g |
| Ethylene dichloride | 16 g |
| 2-Methoxyethyl acetate | 12 g |

The thus presensitized lithographic plate was exposed for a duration of 60 seconds to a Fuji PS light (equivalent to Toshiba metal halide lamp Model MU-2000-2-OL, 2 kW) in 1 m from the plate.

The exposed plate was then developed within a developing solution of the following composition at 25° C. for 50 seconds:

| | |
|---|---|
| Sodium metasilicate | 90 g |
| Sodium silicate (JIS No.3) | 4 g |
| Water | 1000 ml |

The developed lithographic plate was set in a Heidelberg KOR-D printer and 150,000 sheets of paper were satisfactorily printed from the plate.

COMPARATIVE EXAMPLE 1

An aluminum plate degreased under the same conditions as in Example 1 was grained in an electrolytic cell with three-phase A.C. (60 cs) applied at a current density of 30 amperes/dm$^2$ for 2 minutes. A grain of the structure shown in FIG. 1 was provided. A presensitized lithographic plate prepared by repeating the procedure of Example 1 was set in a Heidelberg KOR-D printer and only 70,000 sheets of paper could be printed from the plate.

COMPARATIVE EXAMPLE 2

An aluminum plate degreased under the same conditions as in Example 1 was electrochemically grained using the special alternating waveform described in Example 1 under the electrolytic conditions of a HCL concentration of 8 g/l, an anodic voltage of 26 volts, a cathodic voltage of 11 volts, an anodic current density of 30 amperes/dm$^2$, a cathodic current density of 13 amperes/dm$^2$, a temperature of 36° C. and a duration of 90 seconds.

The treated plate had a grain of the structure shown in FIG. 3. The support thus prepared was coated with a photosensitive layer to provide a dry coationg weight of 2.5 g/m$^2$ and subjected to necessary procedures for making a lithographic plate. The plate was then set in a Heidelberg KOR-D printer which could print only 80,000 sheets of paper from the plate.

COMPARATIVE EXAMPLE 3

A support electrochemically grained under the same conditions as in Comparative Example 2 was coated with a photosensitive layer to provide a dry coating weight of 3.2 g/m$^2$ and subjected to necessary procedures for making a lithographic plate. The plate was then set in a Heidelberg KOR-D printer which could print only 85,000 sheets of paper from the plate.

EXAMPLE 2

An aluminum plate 0.3 mm thick (JIS 1050) was treated with a 20% aqueous sodium hydroxide solution at 40° C. for 20 seconds until any stain, rolling lube and other contaminants attached on the surface were removed. The degreased plate was then immersed in a 15% nitric acid solution to neutralize and desmut the surface.

The plate was then electrochemically grained in a 7 g/l aqueous nitric acid solution using the special alternating waveform described in West German Patent Application (OLS) No. 2650,762 under the electrolytic conditions of an anodic voltage of 27 volts, a cathodic voltage of 9 volts, an anodic current density of 44 amperes/dm$^2$, a cathodic current density of 14 amperes/dm$^2$, a temperature of 22° C. and a duration of 45 seconds. The grained plate was then washed with water.

A grain of the structure shown in FIG. 2 was obtained. The grained plate was immersed in a 15% nitric acid solution at 50° C. for 60 seconds to remove the smut from the surface.

The support thus prepared was anodized in a 20% aqueous sulfuric acid solution for 3 minutes at a current density of 2 amperes/dm$^2$. A 2.6 g/m$^2$ of an oxide film was formed on the surface of the aluminum plate. The anodized support was coated with a photosensitive composition of the formulation specified in Example 1 to provide a dry coating weight of 2.2 g/m$^2$.

The presensitized lithographic plate thus prepared was exposed for 50 seconds to a light source (same as used in Example 1) 1 m from the plate, and developed in the same manner as in Example 1.

The image formed on the aluminum plate had tone reproduction as good as obtained in Example 1, indicating the high printing sensitivity of the lithographic plate of this invention.

The lithographic plate was set in a Heidelberg KOR-D printer and 150,000 sheets of paper could be printed with the plate. The plate had a highly hydrophilic non-image area and exhibited a run as long as that obtained in Example 1, although the photosensitive layer was very thin.

Table 4 below compares Examples 1 and 2 with Comparative Examples 1, 2 and 3 for the distribution of pit diameter, average roughness (Ra) of grain, type of grain, coating weight of the photosensitive composition, sensitivity and run of the resulting lithographic plate prepared.

TABLE 4

Comparison of the properties of lithographic support and plate

| | | Ex. 1 | Ex. 2 | Comp. Ex. 1 | Comp. Ex. 2 | Comp. Ex. 3 |
|---|---|---|---|---|---|---|
| Cumulative frequency of pit diameter | 5% | 3.5 | 4.0 | 2.8 | 3.4 | 3.4 |
| | 95% | 9.5 | 10.0 | 13.2 | 11.5 | 11.5 |
| Center line average roughness (Ra) | | 0.8 | 0.7 | 0.8 | 0.9 | 0.9 |
| Type of grain | | B | B | A | C | C |
| Coating weight of photosensitive composition (g/m$^2$) | | 2.5 | 2.2 | 2.5 | 2.5 | 3.2 |
| Sensitivity (sec) | | 60 | 50 | 65 | 60 | 80 |
| Run (× 10,000) | | 15 | 15 | 7 | 8 | 8.5 |

As can be seen from Table 4 above, the lithographic plate prepared from the support of this invention:

(1) has a long running life;

(2) maintains a long running life and exhibits improved sensitivity, although it has a thinner photosensitive layer.

While the invention has been described in detail and with reference to specific embodiments thereof, it will be apparent to one skilled in the art that various changes and modifications can be made therein without departing from the spirit and scope thereof.

What is claimed:

1. A support for a lithographic plate comprising an aluminum plate or an aluminum-alloy plate the surface of which has been grained such that the grain structure comprises pits and:

(i) the distribution of pit diameter is such that the pits corresponding to 5% and 95% on a cumulative frequency curve for pit diameter are 3$\mu$ or more and 10±1$\mu$ in diameter, respectively; and (ii) the center line average roughness (Ra) of said surface is in the range from 0.6 to 1.0$\mu$.

2. The support of claim 1, wherein the surface of said support is provided with an anodized film.

3. The support of claim 1, wherein said support has been subjected to a suitable surface treatment which renders said support surface hydrophilic.

4. The support of claim 3, wherein said surface treatment comprises treating the surface of said support with an aqueous solution containing an alkali metal silicate.

5. The support of claim 3, wherein said surface treatment comprises providing said support wiht a hydrophilic subbing layer.

6. In a light-sensitive material for the preparation of a lithographic printing plate comprising an aluminum or aluminum-alloy support having provided thereon a photosensitive layer, the improvement which comprises: said support having a grain structure comprising pits wherein:

(i) the distribution of pit diameter is such that the pits corresponding to 5% and 95% on a cumulative frequency curve for pit diameter is about 3 microns or more and about 10±1 micron in diameter, respectively; and (ii) The center line average roughness (Ra) of said surface is in the range of from about 0.6 to 1.0 micron.

7. The light-sensitive material of claim 6, wherein said photosensitive layer is an organic or inorganic sensitizer, photosensitive resin or photoresist which, when irradiated with light undergoes photochemical changes which result in a change in solubility between the exposed and unexposed areas.

8. The light-sensitive material of claim 6, wherein said photosensitive layer comprises a diazo compound.

9. The light-sensitive material of claim 6, wherein said photosensitive layer comprises an azido compound.

10. The light-sensitive material of claim 6, wherein said photosensitive layer comprises a quinone diazido compound.

11. The light-sensitive material of claim 6, wherein said photosensitive layer comprises a compound which is dimerized upon exposure to actinic radiation.

12. The light-sensitive material of claim 6, wherein said photosensitive layer comprises a compound which contains at least two terminal ethylene groups and which is polymerized upon exposure to actinic radiation.

13. The light-sensitive material of claim 6, wherein said support is provided with an anodized layer.

14. The light-sensitive material of claim 6, wherein said support is provided with a subbing layer.

15. The light-sensitive material of claim 13, wherein said photosensitive layer has a coating thickness of 0.5 to 2.5 $g/m^2$.

16. The light-sensitive material of claim 13, wherein said support is provided with a subbing layer of a hydrophilic polymer in a coating amount of 5 to 150 $mg/m^2$ between said anodized layer and said photosensitive layer.

* * * * *